US007755012B2

(12) United States Patent
Mock

(10) Patent No.: US 7,755,012 B2
(45) Date of Patent: Jul. 13, 2010

(54) ECCENTRIC DRIVE CONTROL ACTUATION SYSTEM

(75) Inventor: M Robert Mock, Moorpark, CA (US)

(73) Assignee: HR Textron, Inc., Santa Clarita, CA (US)

( * ) Notice: Subject to any disclaimer, the term of this patent is extended or adjusted under 35 U.S.C. 154(b) by 767 days.

(21) Appl. No.: 11/651,864

(22) Filed: Jan. 10, 2007

(65) Prior Publication Data

US 2010/0147992 A1 Jun. 17, 2010

(51) Int. Cl.

| | |
|---|---|
| ***F42B 10/26*** | (2006.01) |
| ***F42B 15/01*** | (2006.01) |
| *F42B 10/00* | (2006.01) |
| *F42B 15/00* | (2006.01) |

(52) U.S. Cl. ..... 244/3.23; 244/3.1; 244/3.15; 244/3.21; 102/501

(58) Field of Classification Search ..... 244/3.1–3.3; 89/1.11; 102/501–529

See application file for complete search history.

(56) References Cited

U.S. PATENT DOCUMENTS

| | | | | |
|---|---|---|---|---|
| 3,260,205 | A * | 7/1966 | Dietrich | 244/3.23 |
| 3,611,943 | A | 10/1971 | Popper et al. | |
| 3,747,529 | A | 7/1973 | Plattner | |
| 3,826,193 | A | 7/1974 | Rognmo et al. | |
| 3,994,228 | A | 11/1976 | Hurlimann | |
| 4,004,519 | A | 1/1977 | Hopkins | |
| 4,088,076 | A | 5/1978 | Karayannis | |
| 4,142,696 | A | 3/1979 | Nottingham | |
| 4,248,153 | A | 2/1981 | Sjotun et al. | |
| 4,565,340 | A * | 1/1986 | Bains | 244/3.28 |
| 4,577,116 | A | 3/1986 | Pinson | |
| 4,665,332 | A | 5/1987 | Meir | |
| 4,898,342 | A | 2/1990 | Kranz et al. | |
| 4,964,593 | A | 10/1990 | Kranz | |
| 5,115,742 | A | 5/1992 | Frazer | |
| 5,127,605 | A * | 7/1992 | Atchison et al. | 244/3.27 |
| 5,186,413 | A * | 2/1993 | Deakin | 244/3.28 |
| 5,322,243 | A | 6/1994 | Stoy | |
| 5,409,185 | A | 4/1995 | Oldakowski | |
| 5,452,864 | A | 9/1995 | Alford et al. | |

(Continued)

FOREIGN PATENT DOCUMENTS

| | | |
|---|---|---|
| EP | 0744591 | 11/1996 |

OTHER PUBLICATIONS

International Search Report and Written Opinion from PCT/US2007/088912, mailed on Dec. 22, 2008.

*Primary Examiner*—Bernarr E Gregory
(74) *Attorney, Agent, or Firm*—BainwoodHuang

(57) ABSTRACT

A control surface actuation system has the ability to move aerodynamic control surfaces using a rotational motion of a motor. In an arrangement, rotational motion of the motor enables the aerodynamic control surfaces of a rotating projectile to oscillate and thus vary the angle of the control surfaces as the projectile spins. The rotation of a motor in one direction in combination with a gear and a link and a crank arm attached to a shaft of the aerodynamic control surfaces allows the control surfaces to move in fluttering motion to induce the maneuvering of a projectile in the desired direction. A controller takes information regarding the current condition of the projectile and drives the motor to move the aerodynamic devices to maneuver the projectile.

24 Claims, 18 Drawing Sheets

U.S. PATENT DOCUMENTS

| | | | | |
|---|---|---|---|---|
| 6,604,705 | B2 * | 8/2003 | Pellegri et al. | 244/3.24 |
| 6,817,568 | B2 * | 11/2004 | Spate et al. | 244/3.15 |
| 6,827,310 | B1 | 12/2004 | Whitman | |
| 6,845,714 | B1 | 1/2005 | Smith et al. | |
| 6,869,044 | B2 * | 3/2005 | Geswender et al. | 244/3.29 |
| 6,910,657 | B2 * | 6/2005 | Schneider | 244/3.11 |
| 7,095,193 | B2 | 8/2006 | Kellogg et al. | |
| 7,109,679 | B2 | 9/2006 | Edson et al. | |
| 7,116,100 | B1 | 10/2006 | Mock et al. | |
| 2002/0139896 | A1 * | 10/2002 | Pellegri et al. | 244/3.24 |
| 2004/0232278 | A1 * | 11/2004 | Geswender et al. | 244/3.28 |
| 2005/0116113 | A1 | 6/2005 | Lawless | |
| 2008/0006736 | A1 | 1/2008 | Banks | |

* cited by examiner

ECCENTRIC DRIVE CONTROL ACTUATION SYSTEM

BACKGROUND OF THE INVENTION

There are various ways to deliver an explosive device to a target. These methods use various vehicles including guided missiles, guided or smart artillery shells, dumb artillery shells, guided or smart bombs, and dumb bombs. There are benefits and detriments to each type of device.

Guided missiles are very accurate and include an internal propulsion system. However, the cost per vehicle, missile, is very expensive. Guided or smart artillery shells are not as expensive per item. However, the shell does not have its own propulsion method.

Guided or smart artillery shells have a force-producing device to maneuver the projectile during the flight. The force-producing device can be an aerodynamic device, such as a movable fin, to interact with the airflow which alters the path of the projectile. Projectiles from a rifled cannon and some missiles spin to maintain stability. Other missiles or projectiles may spin simply because they have no device to control or prevent the spin. With the projectile spinning at a high rate, the force-producing device needs to move quickly to account for the spinning of the projectile. A servo-actuator used to reposition the aerodynamic device needs to be capable of moving at a rate sufficient to move the aerodynamic device at a rate that will match to the spin rate of the projectile.

Dumb artillery shells are significantly cheaper per shell than the guided missiles and cheaper than the guided or smart artillery shells. However, when firing dumb artillery shells, the first shells tend to miss their target with a wide dispersion. This delivery process is successful through a trial and correction process to adjust for conditions including environment.

BRIEF SUMMARY OF THE INVENTION

It is recognized that an artillery shell or a projectile receives stability from the spin placed on the shell as it is launched. Unfortunately, there are deficiencies to the above-described projectiles. The projectiles are either very expensive per projectile such as in a guided missile or are inaccurate as in a dumb artillery shell. In conventional guided or smart artillery shells, the guidance and control system needs to maneuver a spinning projectile by ongoing repositioning of an aerodynamic device with a servo-actuator. With this requirement, the servo-actuator needs to operate in a high performance regime characterized by high amplitude and high bandwidth. This high performance is achieved at a significant cost, weight, or projectile life penalty.

In contrast to the conventional projectiles, embodiments of the invention are directed to techniques of maneuvering a body using a motor rotational in one direction to move an aerodynamic device in an oscillating motion. A single-use projectile having a control surface actuation system of the invention can be lighter and less costly than conventional projectiles. The projectile can be guided to the target efficiently and cost effectively. Accordingly, the conventional approach of heavy and expensive servo-actuators capable of moving the actuator's shaft in a back and forth motion quickly is unnecessary.

In one arrangement, the projectile has a body having an aerodynamic nose and a pair of aerodynamic devices. The aerodynamic devices, a pair of fins, are rotatably carried by the body. A shaft extends between the fins. The fins could be rigidly attached to the fin shaft or pivotally attached to the fin shaft so the fins can be stowed. A crank is coupled to the shaft where a general back and forth lateral motion of the crank causes an oscillating motion of the shaft and the fins. The projectile has a motor and a link. The link is interposed between the crank and the motor for translating rotational motion of the motor into generally lateral motion of the link that is, in turn, converted into rotationally oscillating motion at the crank; wherein the rotational motion of the motor is translated into an oscillating motion of the aerodynamic devices relative to the body of the projectile.

The projectile has a controller for controlling the position, the speed, and the acceleration of the motor to adjust the oscillation rate and timing of the aerodynamic devices. The controller receives inputs related to the spin velocity ($\omega$) of the projectile; the spin coordination angle ($\theta$) of the projectile; and the required phase angle ($\beta$) of the aerodynamic devices of the projectile. Further, the controller receives feedback signals for the position of the aerodynamic device or the motor and the velocity of the aerodynamic device or the motor. The controller outputs a signal to vary the electrical power applied to the motor thereby adjusting the position of the aerodynamic devices in the aerodynamic devices' oscillation motion.

In an arrangement, the motor carries a pinion. A gear is coupled to the pinion and carries an end of the link. The gear drives, through the link, the transverse lateral motion of the crank at a frequency proportional to the rotational speed of the motor. The gear and the pinion are matched to move the link at a rate of over 100 strokes per minute. In an arrangement, the gear and the pinion are matched to move the link at a rate of between 400 strokes to 1000 strokes per minute. A plurality of gear sets can be used to obtain the desired gear ratio between the motor and the end of the link. Stroke rates ranging from less than 50 strokes per minute (very slow) to 16,000 strokes per minute are obtained by selecting the proper gearing and link arrangement to produce the application appropriate rate (the spin rate of the projectile).

In an arrangement, the motor carries a pinion. A gear is coupled to the pinion. A pair of stop pins is carried by the gear. The control surface actuation system has an arm having a pair of ends. One end of the arm is pivotally carried by the gear. The other end of the arm is pivotally carried by the first end of the linkage. The rotation of the gear in one direction moves the arm into engagement with one of the stop pins and establishes a first specific amplitude of the aerodynamic device. The rotation of the gear in the other direction moves the arm into engagement with the other stop pin and establishes another specific amplitude of the aerodynamic device.

In an arrangement, the crank carried by the shaft of the control surface actuation system has a slot for receiving one end of the link. The system has an adjustment device for positioning that one of the end of the link in a specific position within the slot to adjust the angular amplitude of oscillatory motion of the crank as the motor rotates.

In an arrangement, the aerodynamic device for the projectile is a pair of opposing valves for directing a flow of air transversely through the projectile from one valve to the other valve. The flow of the air through the body of the projectile will redistribute the pressures acting on the projectile; the valve surfaces, when open, will when open will protrude into the air stream creating lift and drag, and will also change the boundary layer of the projectile, all acting to alter the flight path of the projectile.

A control surface actuation system has a control surface. The control surface has a shaft and is rotatably carried by a body. A crank is affixed to the shaft or control surface. A lateral motion of the crank causes a rotational motion of the control surface about the axis of the shaft. A link is interposed between the crank and the motor for translating rotational motion of the motor into rotationally oscillating motion of the crank. The rotational motion of the motor is translated into rotational motion of the control surface via a lateral motion of the link.

In an arrangement, at least one gear is interposed between the motor and the link for translating high speed low torque motion into lower speed higher torque motion. The motor has a longitudinal axis that is parallel with the shaft of the control surface.

In an arrangement, the control surface actuation system has a gear box having at least one gear coupled to the motor. An arm extends from the gear box to the link. The link has a first end coupled to the arm and a second end coupled to the crank. Each end of the link is coupled to the arm and the crank by a joint having as much as three degrees of freedom. In an embodiment, the joint is a ball joint.

In an arrangement, the control surface is a pair of aerodynamic surfaces wherein each of the aerodynamic surfaces has an associated linkage. In an embodiment the aerodynamic surfaces are air brake panels.

In an arrangement, a method of controlling a projectile includes rotating a projectile with a pair of aerodynamic surfaces. The aerodynamic devices moving in an oscillating motion influence the flight path of the projectile by moving the pair of aerodynamic devices to control the flight path of the projectile.

In one method, the projectile is fired from a gun that creates a rotation of the projectile along a longitudinal axis of the projectile due to the rifling of the barrel of the gun. A shaft of a motor is driven in a circular motion at a varying rate. The aerodynamic devices are moved in an oscillating motion through a link coupled to the rotating shaft of the motor.

In one method, the projectile is a bomb with or without spin about its longitudinal axis. In another method, the projectile is a missile with or without spin about its longitudinal axis.

BRIEF DESCRIPTION OF THE DRAWINGS

The foregoing and other objects, features, and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

An improved control surface actuation system has the ability to move aerodynamic control surfaces using a rotational motion of a motor. In an arrangement, rotational motion of the motor enables the aerodynamic control surfaces of a rotating projectile to oscillate and thus continuously vary the angle of the control surfaces as the projectile spins. The rotation of a motor in one direction in combination with a gear and a link and a crank arm attached to a shaft of the aerodynamic control surfaces allows the control surfaces to move in fluttering motion to induce the maneuvering of a projectile in the desired direction. A controller takes information regarding the current condition of the projectile and drives the motor to move the aerodynamic devices to maneuver the projectile. Accordingly, taking the conventional approach by using a high performance servo-actuator would require the servo-actuator to operate at high amplitude over a high bandwidth is unnecessary. Substituting the invention for such a high amplitude and bandwidth servo actuator yields a solution where the motor operates in a continuous unidirectional mode with no back-and-forth operation.

Figure 1:
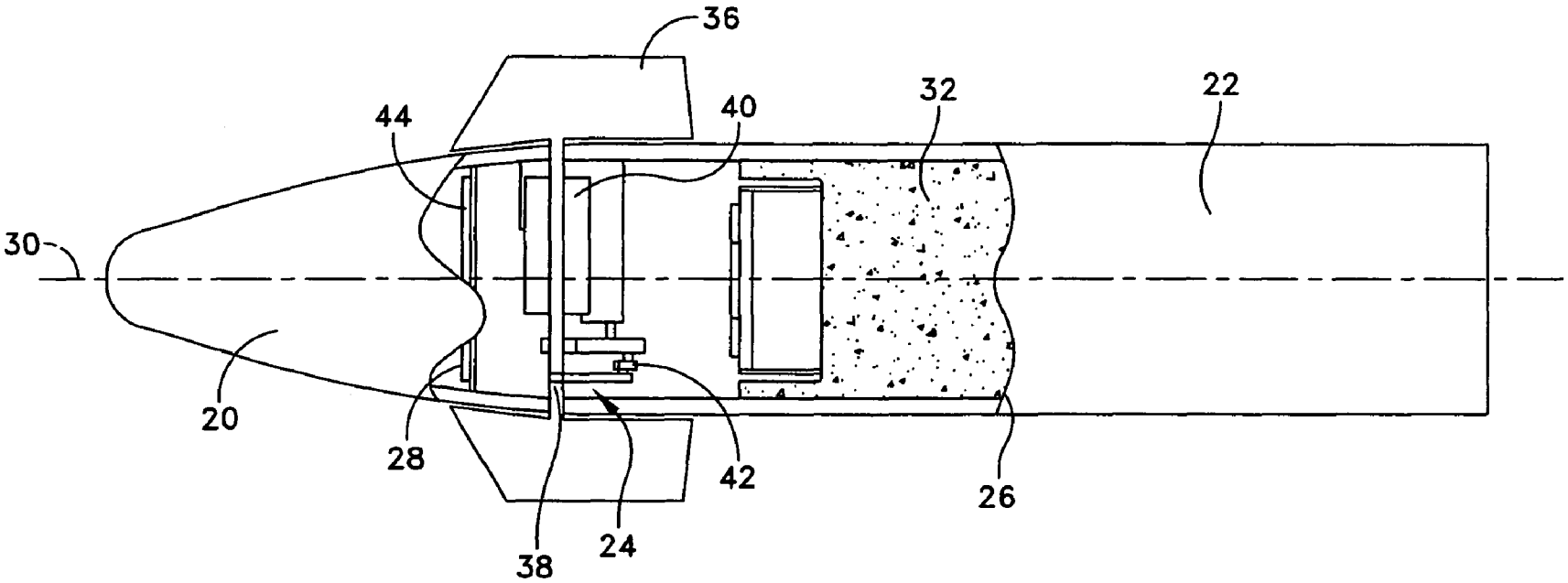
FIG. 1 is a side elevation partial cutaway view of a projectile.

FIG. 1 shows a projectile 20 with a portion of an outer casing 22 broken away to show a portion of the interior of the projectile 20. The projectile 20 has a shell 26 and a guidance and control portion 28. A longitudinal axis 30 of the projectile 20, about which the projectile 20 generally rotates is shown. The shell 26 has an outer casing 22 shown in section in FIG. 1.

The guidance and control portion 28 has a pair of control surfaces or aerodynamic devices 36. In some arrangements, the aerodynamic devices 36 are a pair of fins or carnards which are connected by a shaft 38 that extends between the fins 36. The guidance and control portion 28 has a control surface actuation system, a drive arrangement 24, having a motor 40 and a link 42 to move the shaft 38 and the fins 36 as explained in further detail below.

In addition, the guidance and control portion 28 has a plurality of elements 44 such as GPS sensors, inertial sensors, and controller hardware and software for the projectile 20, and fire control devices. Some of elements 44 are used to detonate the explosive charge 32 in the projectile 20 when activated. The elements 44 also determine the location of the projectile and guide the projectile as explained in further detail below.

Figure 2:
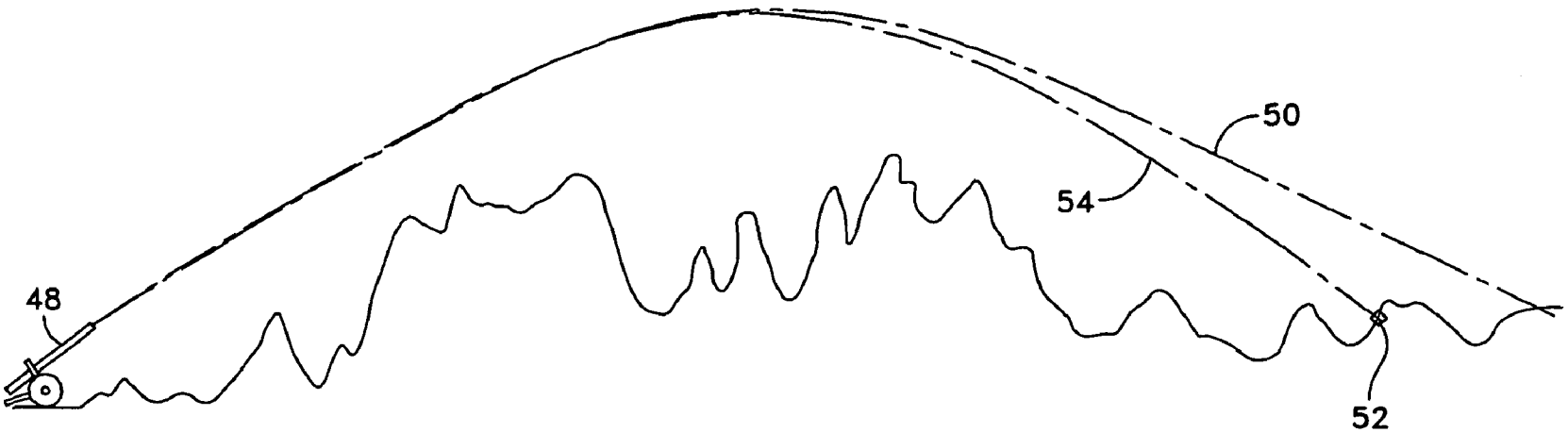
FIG. 2 is an illustration of the flight of the projectile.

Referring to FIG. 2, a schematic of the flight path of a projectile 20 is shown. The projectile 20 is launched from a cannon 48. The cannon 48 has rifling in its barrel. The rifling imparts a spin on the projectile 20 as the projectile 20 leaves the barrel of the cannon 48 at a very high velocity due to the high acceleration imparted on the projectile 20. The spin imparted on the projectile 20 results in a more stable projectile 20 as it travels a flight path.

In conventional projectiles, the projectiles are not controlled after they leave the launch location (i.e., cannon 20.) Such a flight path is represented by line 50. Due to several factors including weather conditions such as wind and humidity, the exact location where the projectile is going to land is difficult to determine. It is therefore common for conventional projectiles to miss their target 52 with a wide dispersion and typically only successfully hit the target through a process of trial and correction.

The projectile 20 of the arrangements described below is capable of maneuvering during flight to improve the success rate of hitting the target. The projectile 20 does not have a propulsion system. As is described below, the projectile 20 can be controlled to alter the flight path. The alterations can include reducing and increasing the distance the projectile 20 travels. In addition, the projectile 20 can be maneuvered to the left and the right. An altered flight path of the projectile 20 as described is represented by line 54.

In the arrangement shown, the cannon 48 places a clockwise spin on the projectile 20 when looking from the rear of the projectile 20. The aerodynamic surfaces, the fins, are moved in a sequence to influence the flight path of the projectile. In that the projectile is spinning typically in the range of 50 to 300 revolutions per second, the angular position of the aerodynamic surfaces is changing relative to the longitudinal axis 30 of the projectile. This occurs as the projectile travels along its flight path.

Figure 3:
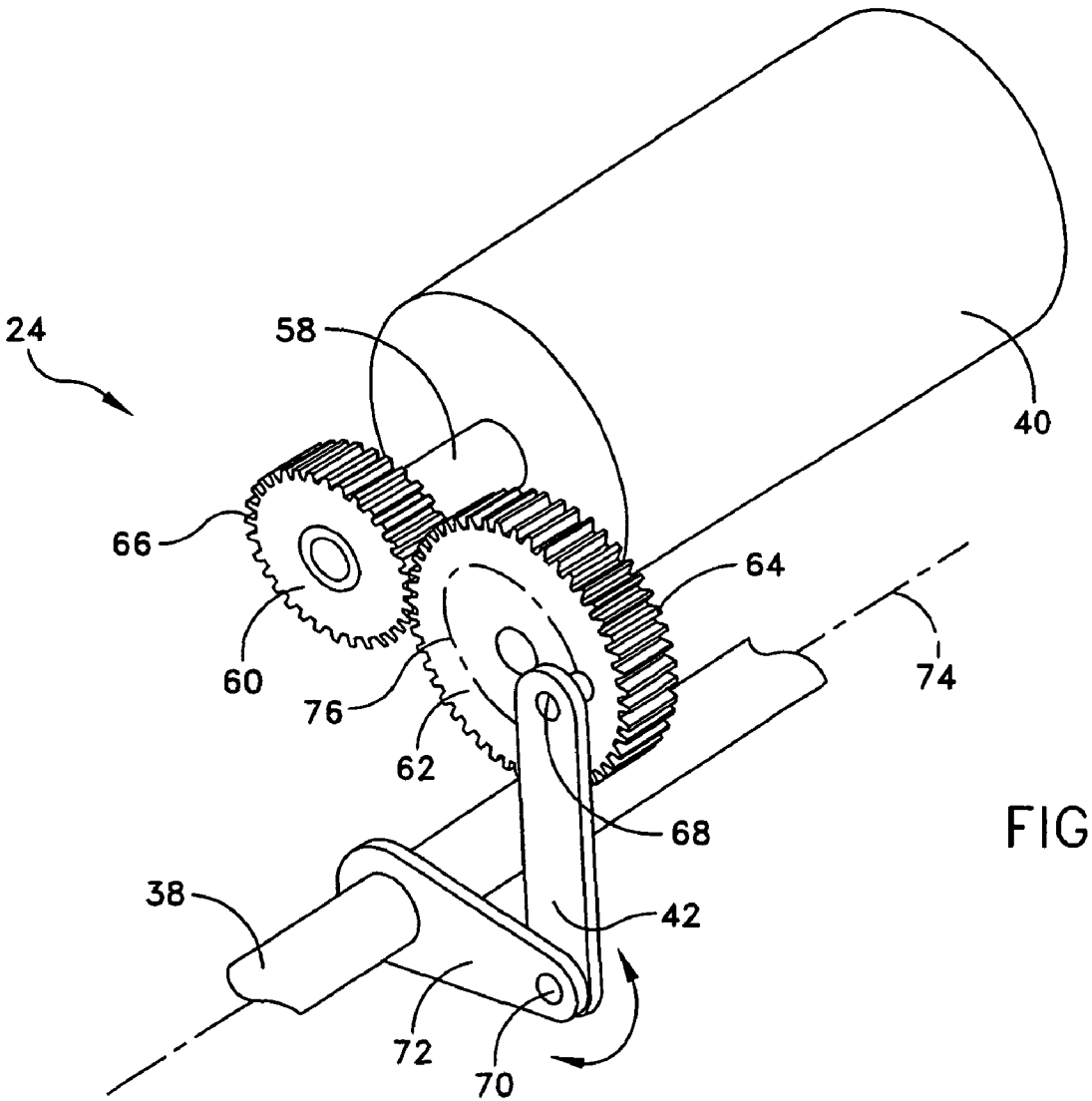
FIG. 3 is a perspective view of a control surface actuation system.

Referring to FIG. 3, the figure shows a perspective view of the control surface actuation system 24 including the motor 40 and a portion of the shaft 38 between the fins 36, shown in FIG. 1. The motor 40 has a shaft 58 that is connected to a pinion 60. A primary gear, a spur gear 62, is rotatably mounted such that the teeth 64 of the primary gear 62 engage the teeth 66 of the pinion 60. The link 42 has a first end 68 pivotally mounted to the primary gear 62. The link 42 has a second end 70 that is pivotally mounted to a crank 72 that is affixed to the fin shaft 38. The crank 72 constrains the movement of the second end 70 of the link 42 to a semi-circular path about the rotational axis 74 of the shaft 38.

As the motor 40 and the pinion gear 60 rotate in a clockwise direction in FIG. 3 the primary gear 62 rotates in a counterclockwise direction. With the rotation of the primary gear 62, the location 76 where the first end 68 of the link 42 connects to the primary gear 62 moves in a circular path shown in phantom in FIG. 3. The second end 70 of the link 42 is moved in a generally transverse oscillating arc; this oscillating motion of the second end 70 of the link 42 results in the crank 72 rotating the shaft 38 which oscillates the fins 36 as seen in FIG. 4.

Figure 4:
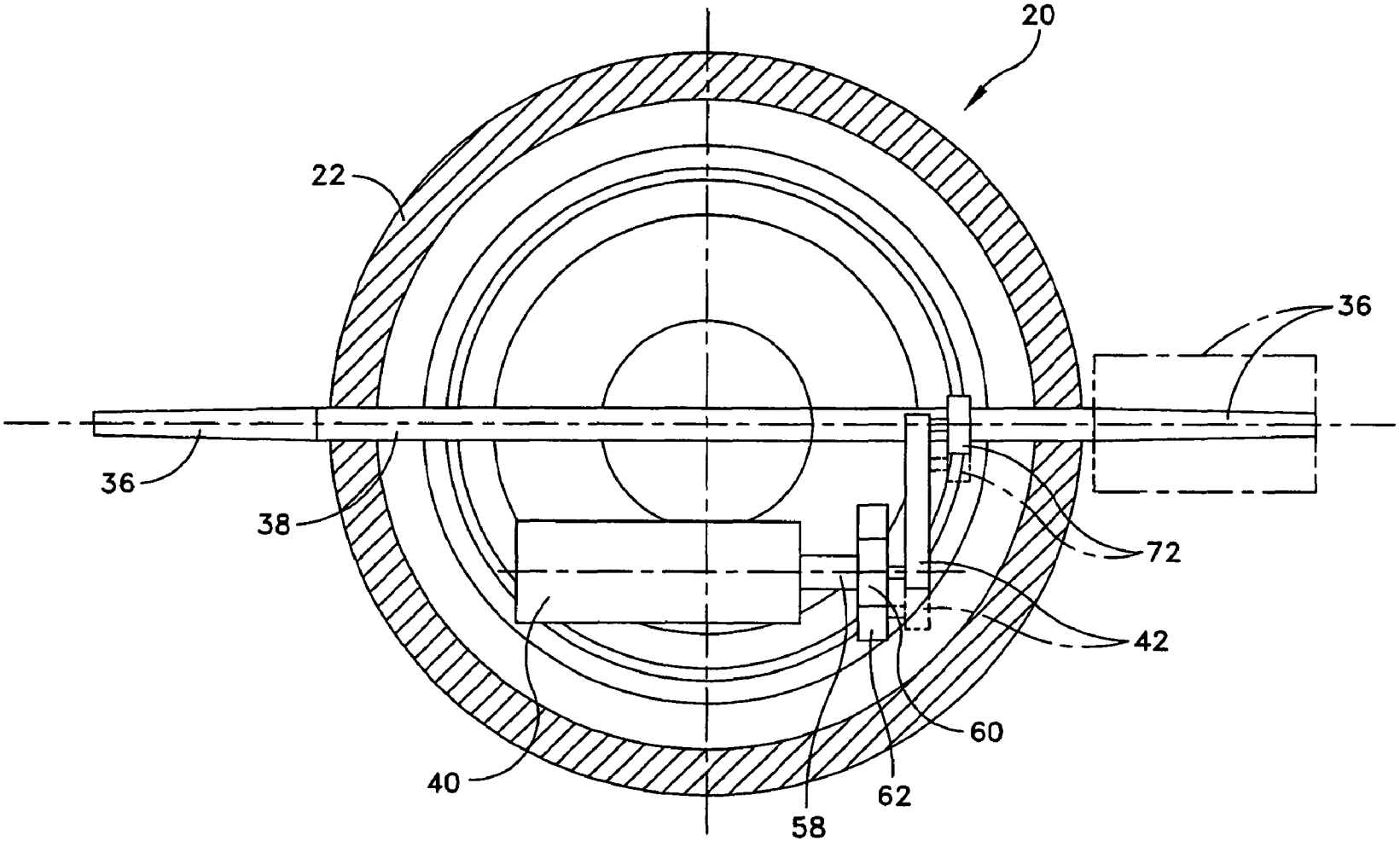
FIG. 4 is an enlarged cross section of a portion of the projectile.

FIG. 4 is a cross sectional view of the projectile 20 looking from the front. The shaft 38 is seen extending through the outer casing 22 to the fin 36. The motor 40 is shown in the lower portion of the projectile 20. The pinion gear 60 and the primary gear 62 are to the right of the motor in the FIG. 4. The link 42 is pinned and interposed between the primary gear 62 and the crank 72. The fins 36 are shown in a neutral position.

The link 42, the crank 72, and the fins 36 are shown in phantom when the fins 36 are at an angle of attack of 20°.

Figure 5F:
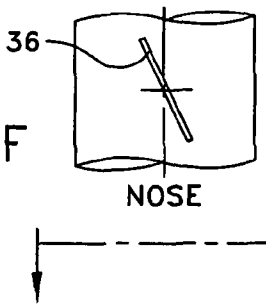
FIGS. 5E and 5F are side views of sectional views of FIGS. 5B and 5D respectively.
Figure 5D:
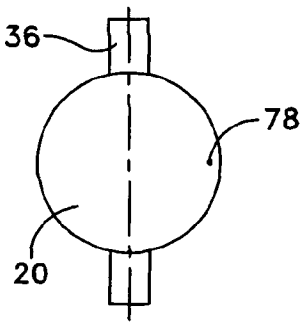
FIGS. 5A-5D is a schematic of four positions of the projectile in its rotation.
Figure 5C:
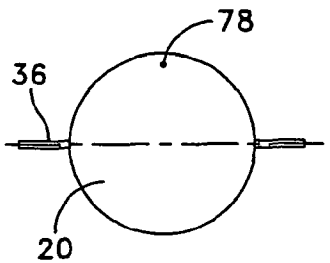
Figure 5B:
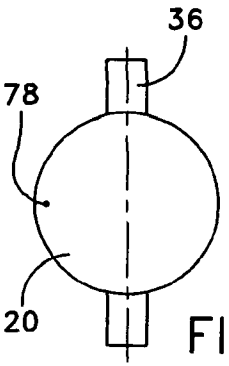
Figure 5E:
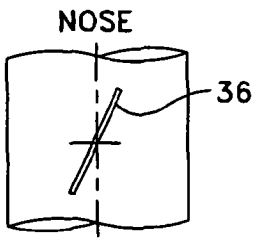
Figure 5A:
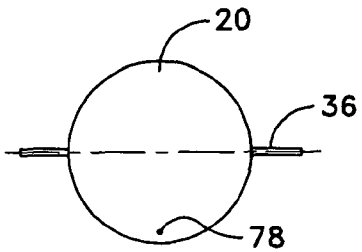

In an arrangement, the projectile 20 is spinning clockwise as the projectile 20 travels through the air. The angular position of the fins 36 relative to the projectile longitudinal axis will constantly be changing. FIGS. 5A, 5B, 5C, and 5D show four positions of the projectile 20, looking from the front, that are each rotated 90° relative to the position in the adjacent figure. From the perspective shown in this set of figures, the projectile 20 is being guided to veer to the right. The dot 78 on the projectile 20 represents the same position on the projectile 20. If the projectile 20 is spinning at a rate of 100 revolutions in a second, the projectile 20 goes through each position 100 times in one second. FIG. 5E shows the side view of a section of the projectile shown in FIG. 5B. FIG. 5F shows the side view of a section of the projectile shown in FIG. 5D.

One end of a fin will revolve one full rotation about the projectile axis during the spin period, for example, 10 milliseconds for a spin rate of 100 revolutions per second. Simultaneously, the projectile travels along its path.

In the arrangement shown in FIGS. 3 and 4, the gear 62, the link 42, and the crank 72 kinematics constrain the shaft 38 rotation between the two angular extremes of the shaft motion. The rotational speed of the motor 40 establishes the fin 36 and shaft 38 oscillating frequency. The kinematics established by the gear 62, link 42, and crank 72 can produce an angle vs. time relationship that is not purely sinusoidal motion. For example, the motion angle vs. time relation might be skewed relative to a sinusoid or it may tend to dwell at the peaks in the relationship. Further, variation in the angle vs. time relationship of the shaft 38 and the fins 36 can be tailored by intentional variations in motor 40 rotational speed.

Figure 6:
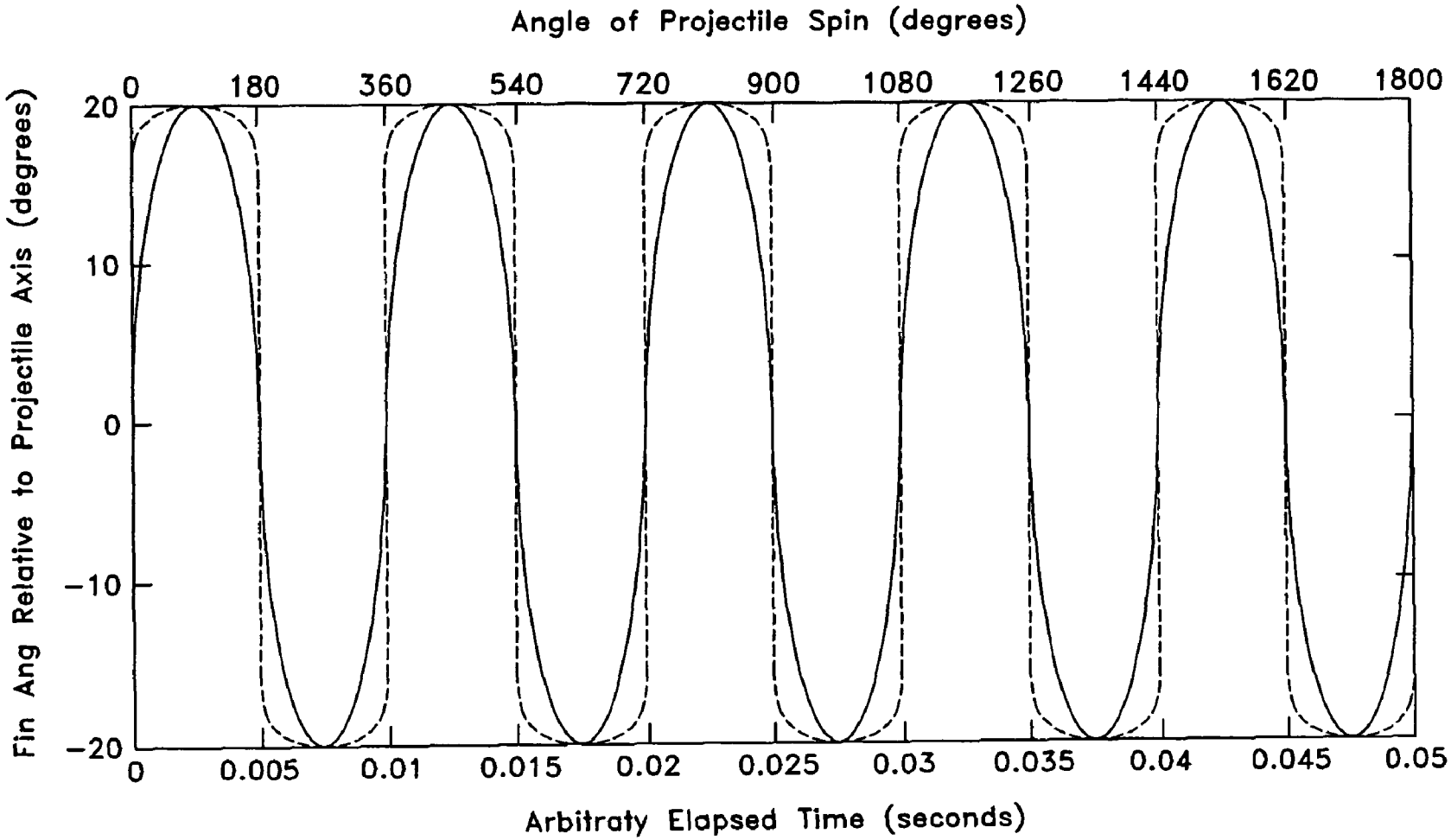
FIG. 6 is a graphical representation of the deflection of an aerodynamic surface.

FIG. 6 is a representation of the fin angle vs. time relationship, that is, the angle of the fins relative to the projectile longitudinal axis. Note that the projectile will spin at a nearly constant rate, thus the projectile spin angle is essentially proportional to the time from some arbitrary beginning. Therefore, proportional graduations of time and spin angle are displayed in FIG. 6. In the arrangement shown, the fin angle varies from 20° to −20°. The fin 36 angle is 0° when the position of the projectile 20 corresponds to one of the positions shown in FIG. 5A or 5C, which are represented respectively by 0° and 180° (or some integer multiple thereof) of projectile spin angle in the graph. The fin angle is 20° when the projectile 20 is in the position shown in FIG. 5B, which corresponds to a 90° projectile spin angle in the graph of FIG. 6. The fin angle is −20° when the projectile 20 is in the position shown in FIG. 5D, which corresponds to a 270° projectile spin angle in the graph of FIG. 6. It is the controller that maintains synchronization between the projectile spin and the fin oscillation. In that the projectile spin advances 180°—as the fin moves from one positional extremity to the other—the fin angle in FIGS. 5B and 5D, when viewed from the front of the projectile and relative to the earth is the same in these two positions.

Figure 7:
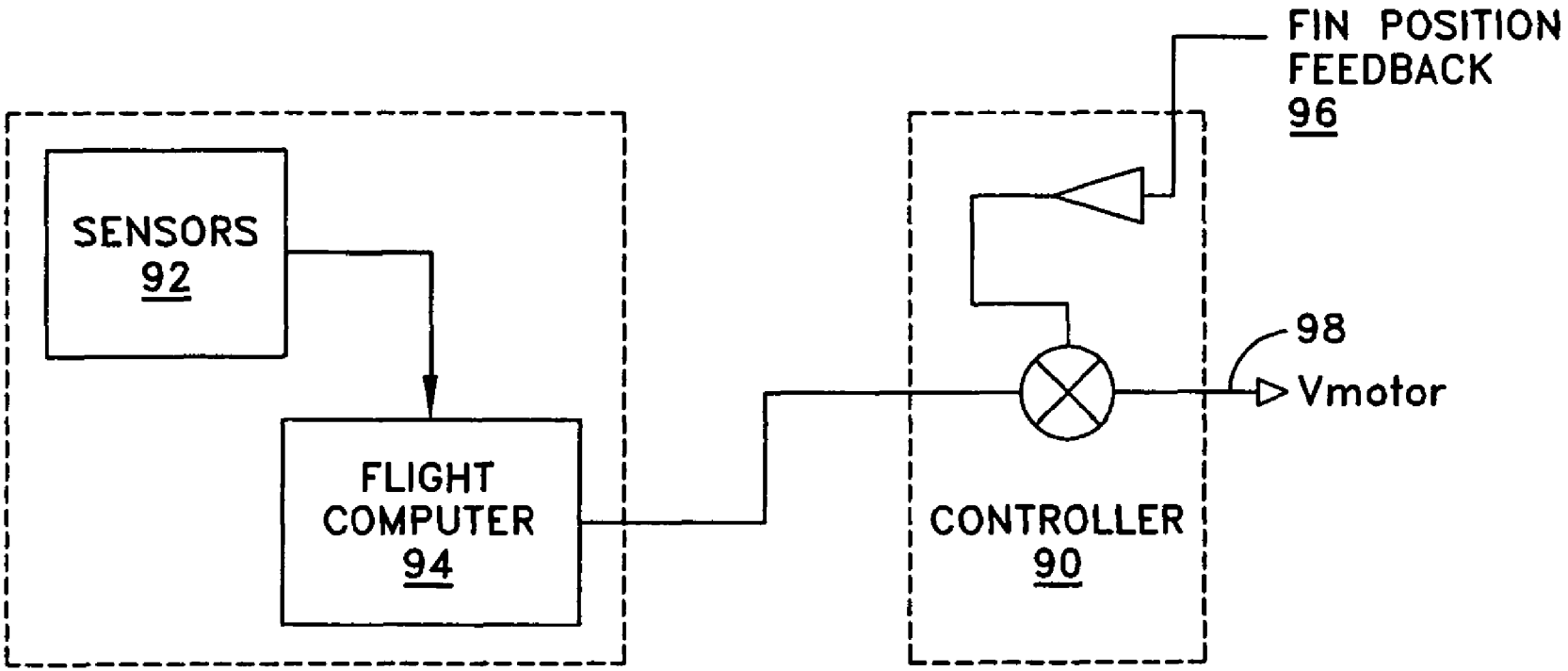
FIG. 7 is a block diagram of a control system.

Still referring to FIG. 6, the fin angle is shown reaching the angle of 20° quickly and tending to maintain this fin angle for a period of time in the graph shown as a dash dot line 80. For the solid line of the graph, the fin angle takes a longer period of time to reach 20° and stays at this angle of attack for a shorter period of time before returning to neutral or 0° fin angle. Modulation of the command relative to spin position or internal controller command adjustments relative to spin position can be used to increase or decrease the tendency to dwell at the fin angle extremes. In order to control the rotation of the motor and the movement of the fins, the projectile 20 has a controller 90 which is shown schematically in FIG. 7. The controller would use the position determined by the sensors 92 of the projectile 20 and the known position of the target 52, as seen in FIG. 2 The flight control computer 94 is among the elements 44 located in the guidance & control portion 28. The controller 90 in addition uses as feed back 96 the position of the aerodynamic devices 36, the fins, in determining what control signal 98 to supply the motor 40, as seen in FIGS. 1, 3, and 4, thereby varying the velocity of the motor 40.

Referring to FIG. 4 and FIGS. 5A-5F, the gear drives, through the link, the transverse lateral motion of the crank at a frequency proportional to the rotational speed of the motor. The gear and the pinion are matched to move the link at a rate of over 100 strokes per minute. In an arrangement, the gear and the pinion are matched to move the link at a rate of between 400 strokes to 1000 strokes per minute. A plurality of gear sets can be used to obtain the desired gear ratio between the motor and the end of the link. Stroke rates ranging from less than 50 strokes per minute (very slow) to 16,000 strokes per minute are obtained by selecting the proper gearing and link arrangement to produce the application appropriate rate (the spin rate of the projectile).

Figure 8:
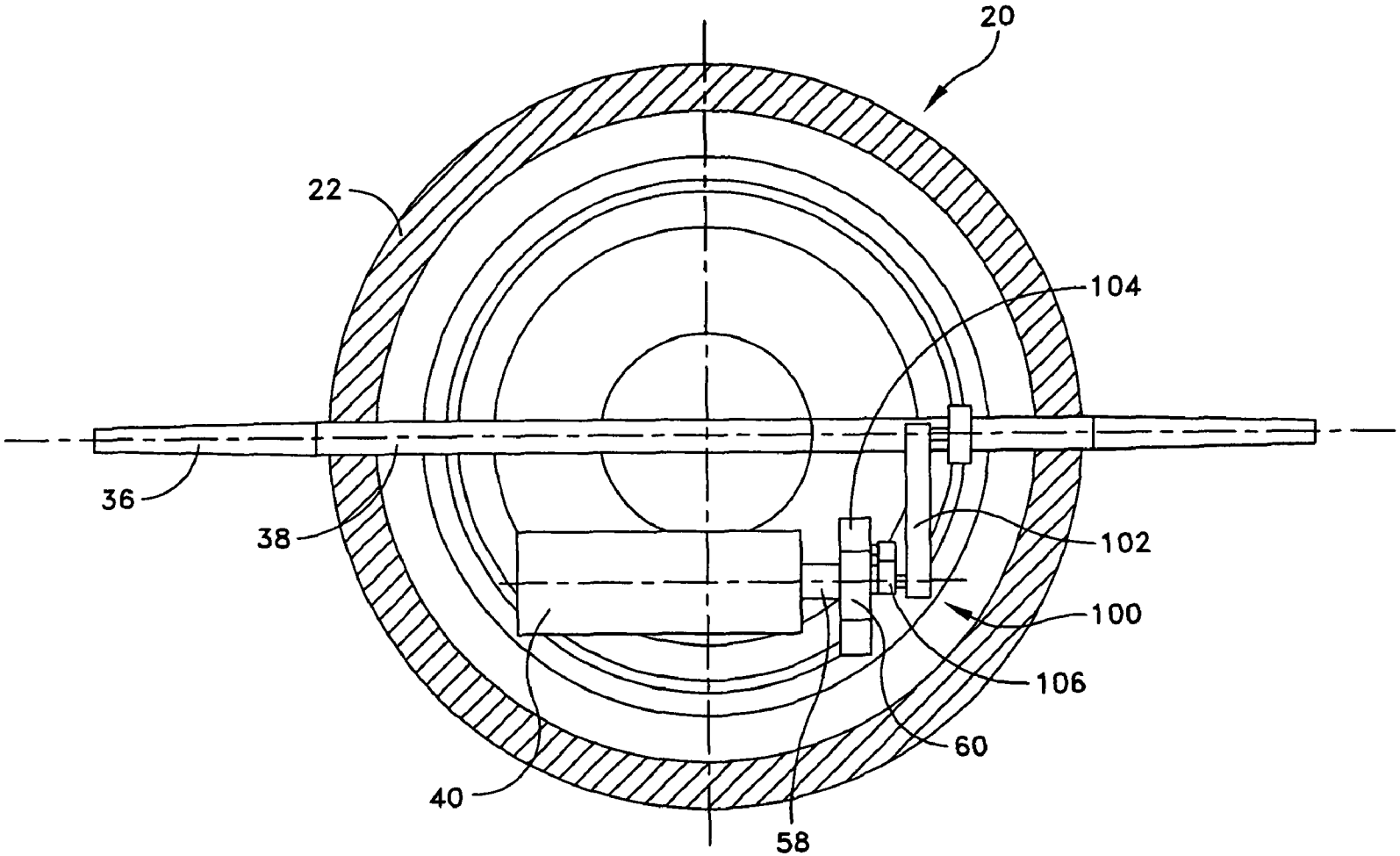
FIG. 8 is an enlarged cross section of a portion of the projectile with a first alternative control surface actuation system.

Referring to FIG. 8, a projectile 20 with an alternative drive arrangement 100, control surface actuation system, is shown. The drive arrangement 100 has a link 102 that is not directly connected to a gear, a primary gear 104. The drive arrangement 100 has an arm 106 that is interposed between the primary gear 104 and the link 102.

Figure 9B:
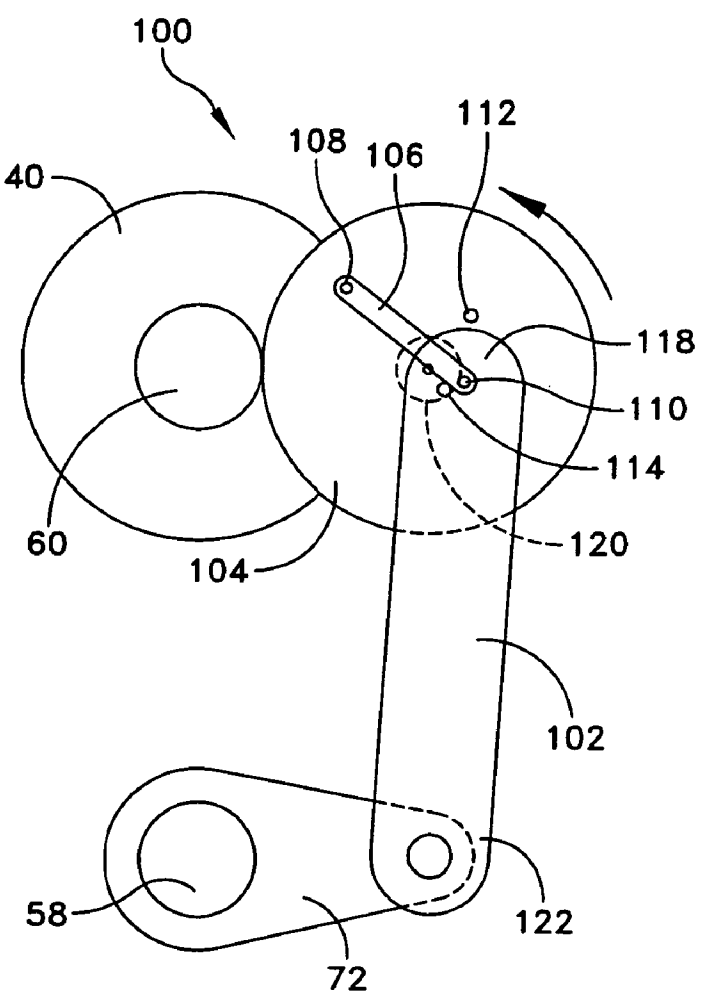
FIG. 9B is a schematic of the first alternative control surface actuation system when the motor is rotated in the clockwise direction.
Figure 9A:
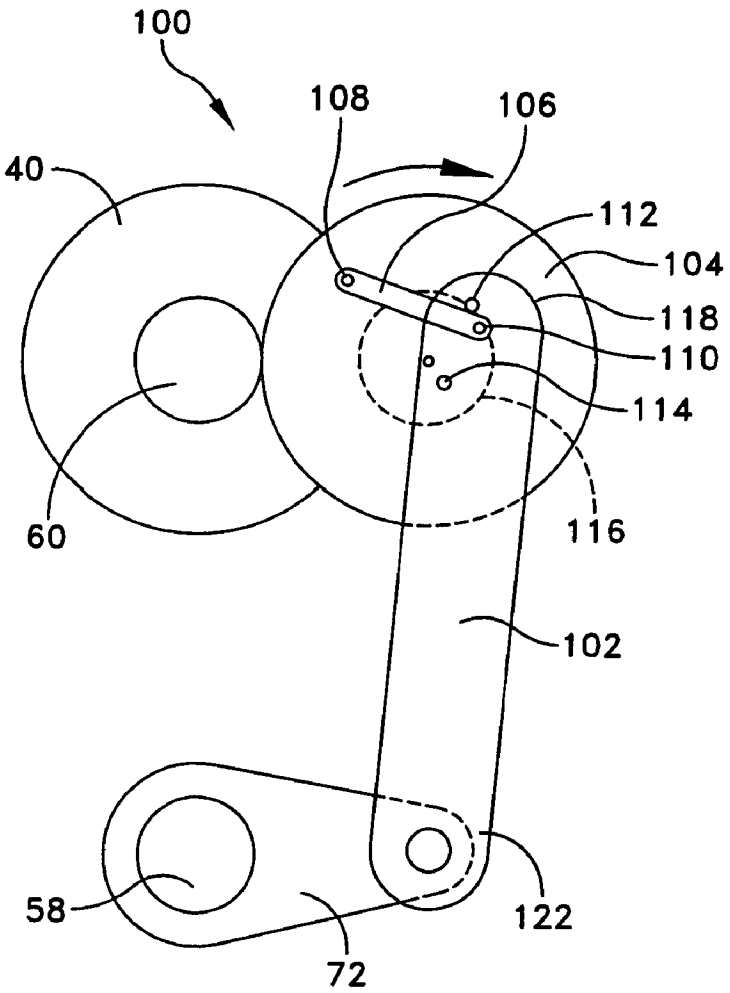
FIG. 9A is a schematic of a first alternative control surface actuation system when the motor is rotated in the counterclockwise direction.

Referring to FIG. 9A, a schematic view of the drive arrangement 100 is shown. The arm 106 has a first end 108 that is pivotally connected to the primary gear 104 and a second end 110 that is pivotally connected to the link 102. The drive arrangement 100 has a pair of stop pins 112 and 114 carried on the primary gear 104 to limit the travel of the arm 106.

Still referring to FIG. 9A, if the motor 40 is rotating counter-clockwise, the pinion 60 rotates the primary gear 104 clockwise. The first stop pin 112 limits the rotation of the arm 106 therefore defining a first path 116 of a first end 118 of the link 102.

Referring to FIG. 9B, if the motor 40 is rotating clockwise, the pinion 60 rotates the primary gear 104 counter-clockwise. The second stop pin 114 limits the rotation of the arm 106 therefore defining a second path 120 of a first end 118 of the link 102.

The second path 120 of the first end 118 of the link 102 is a smaller diameter circle about the center of rotation of the primary gear 104 than the first path 116 of FIG. 9A. The smaller path results in smaller oscillating travel of the second end 122 of the link 102 and the crank 72.

One end of a fin will revolve one full rotation about the projectile axis during the spin period, for example, 10 milliseconds for a spin rate of 100 revolutions per second. Simultaneously, the projectile travels along its path.

Figure 10:
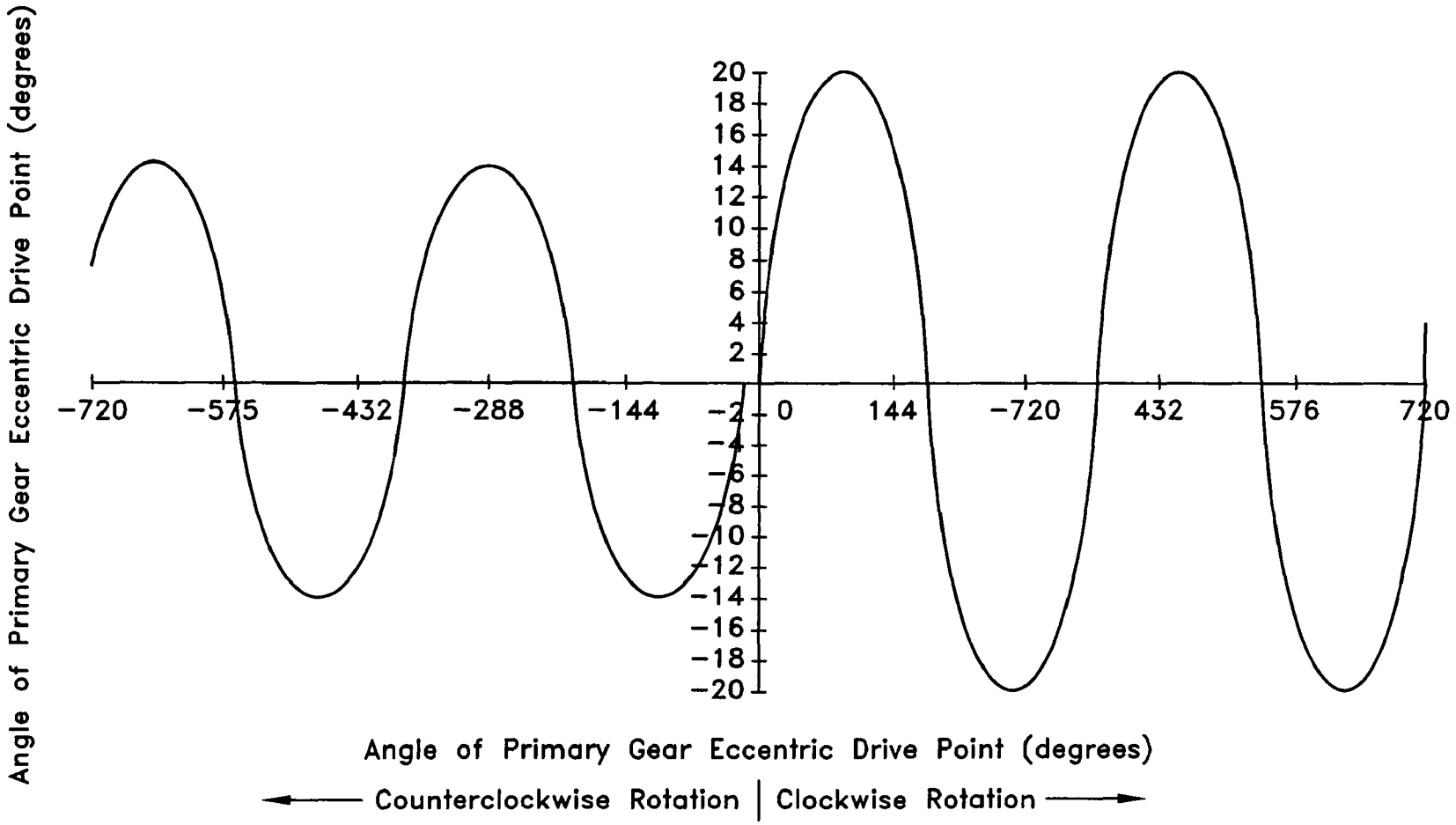
FIG. 10 is a graphical representation of the deflection of an aerodynamic surface.

FIG. 10 is a representation of the fin angle vs. time relationship, that is, the angle of the fins relative to the projectile longitudinal axis. In that the projectile will spin at a nearly constant rate, the projectile spin angle is essentially proportional to the time from some arbitrary beginning. Therefore, proportional graduations of time and spin angle are displayed in FIG. 10. In the arrangement shown, the fin angle varies from 20° to −20° when the primary gear 102 is rotated in a clockwise direction as represented in FIG. 9A. Similar to the arrangement shown in FIGS. 3 and 4, the fin 36 angle is 0° when the position of the projectile 20 corresponds to one of the positions shown in FIG. 5A or 5C, which are represented respectively by 0° and 180° (or some integer multiple thereof) of projectile spin angle in the graph. The fin angle is 20° when the projectile 20 is in the position shown in FIG. 5B, which corresponds to a 90° projectile spin angle in the graph of FIG. 10. The fin angle is −20° when the projectile 20 is in the position shown in FIG. 5D, which corresponds to a 270° projectile spin angle in the graph of FIG. 10. It is the controller that maintains synchronization between the projectile spin and the fin oscillation. In that the projectile's spin advances 180°—as the fin moves from one positional extremity to the other—the fin angle in FIGS. 5B and 5D, when viewed from the front of the projectile and relative to the earth is the same in these two positions.

Referring to FIG. 10, in drive arrangement 100 the primary gear's 104 clockwise rotation results in a 20° to −20° crank 72, shaft 58, and fin 36 oscillation (shown as solid line), while a primary gear 104 counter-clockwise rotation results in a small phase shift and a 14° to −14° oscillation. The controller will maintain synchronization between the projectile spin and the fin oscillation, by application of command and feedback signals, regardless of whether the drive arrangement 100 is rotating the primary gear 104 clockwise, as represented in FIG. 9A, or is rotating the primary gear 104 counter-clockwise, as represented in FIG. 9B.

Figure 11:
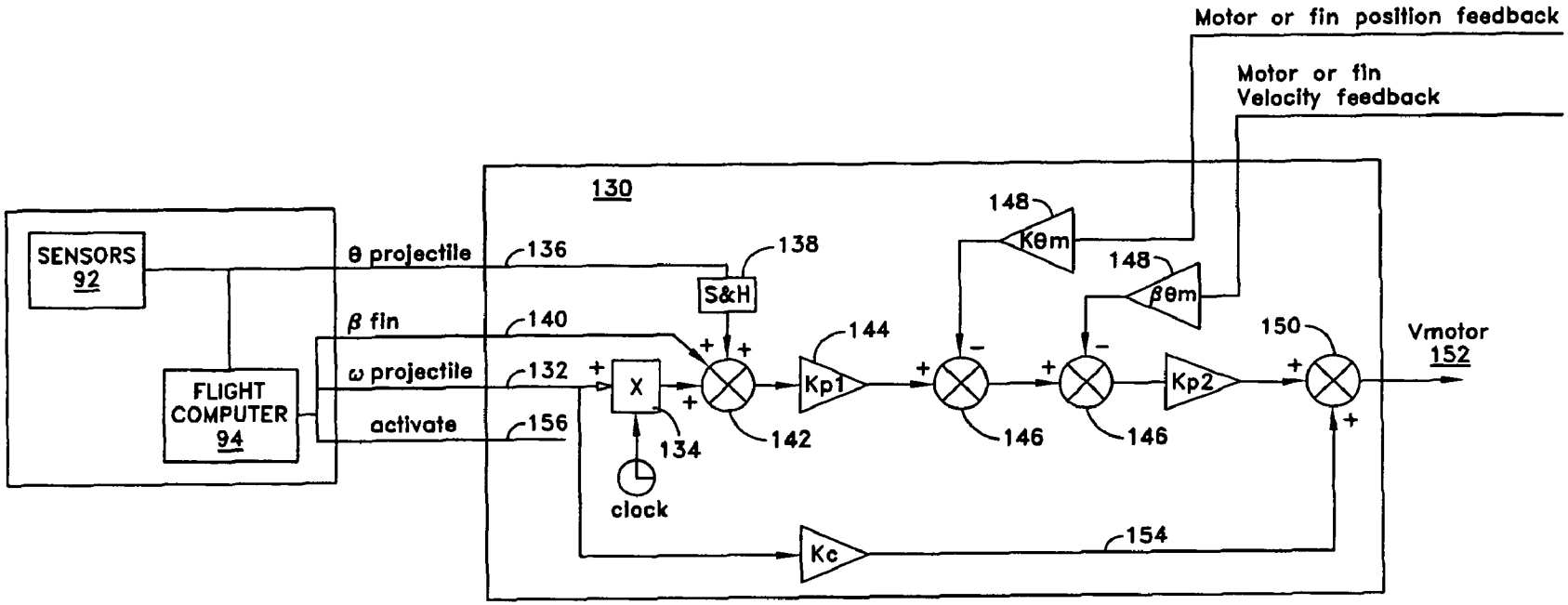
FIG. 11 is a block diagram of a control system.

Referring to FIG. 11, a schematic representation of a controller 130 is shown. The controller 130 shows more detail than the controller 90 shown in FIG. 7. It is recognized that the controller shown in FIG. 7 can take various forms. The controller can include an open loop controller, a closed loop controller, a bang-bang controller, or a proportional controller. The controller 130 is one arrangement of a closed loop controller.

Referring to FIG. 11, the controller 130 takes information regarding the projectile 20 in space, that is the spin velocity (ω) of the projectile 20 and the spin coordination angle (θ) of the projectile 20 as it spins. The controller 130 receives the required phase angle (β) control signal. This is the desired phase angle (β) or vector angle defining the commanded direction of veer for the projectile. In addition, the controller receives feedback from the motor 40 or shaft/fins as to the respective position and velocity. As seen in FIG. 1, a guidance and control system that has various sensors 92 and a flight computer 94 members of the elements 44 located in the guidance and control portion 28 which supplies projectile 20 spin coordination angle (θ), spin velocity (ω), and the required phase angle (θ) signals. The guidance and control system monitors the position of the projectile 20 relative to the ground and the target all along the flight path.

Still referring to FIG. 11, the spin velocity (ω) 132 of the projectile 20 spin is multiplied by the clock function at block 134 resulting in an angular position value. The projectile spin coordination angle (θ) 136 is manipulated in the block 138. The manipulation of the block 138, the output of the block 134, and the required phase angle (β) 140 needed of the fins are summed 42. The signal is amplified 144. This amplified signal is combined 146 with amplified feedback signals 148 from the motor or fin position feedback and the motor or fin velocity feedback. This signal is combined with the amplified angular velocity (ω) 132 feed forward signal 154 of the projectile 20 resulting in the drive signal 152 to drive the motor 40. The flight control computer will send an activate signal 156 when the controller needs to make a course correction. When no course correction is required the activate signal 156 will be set to deactivate and the controller will position the fin in the neutral position, essentially parallel with the projectile's longitudinal axis. In one arrangement the controller 130 is collocated with the flight control computer 94 on the same electronics board or even in the same electronics devices and software. In another arrangement the sensors 92 could be collocated with the controller 130 and the flight control computer 94.

Figure 12:
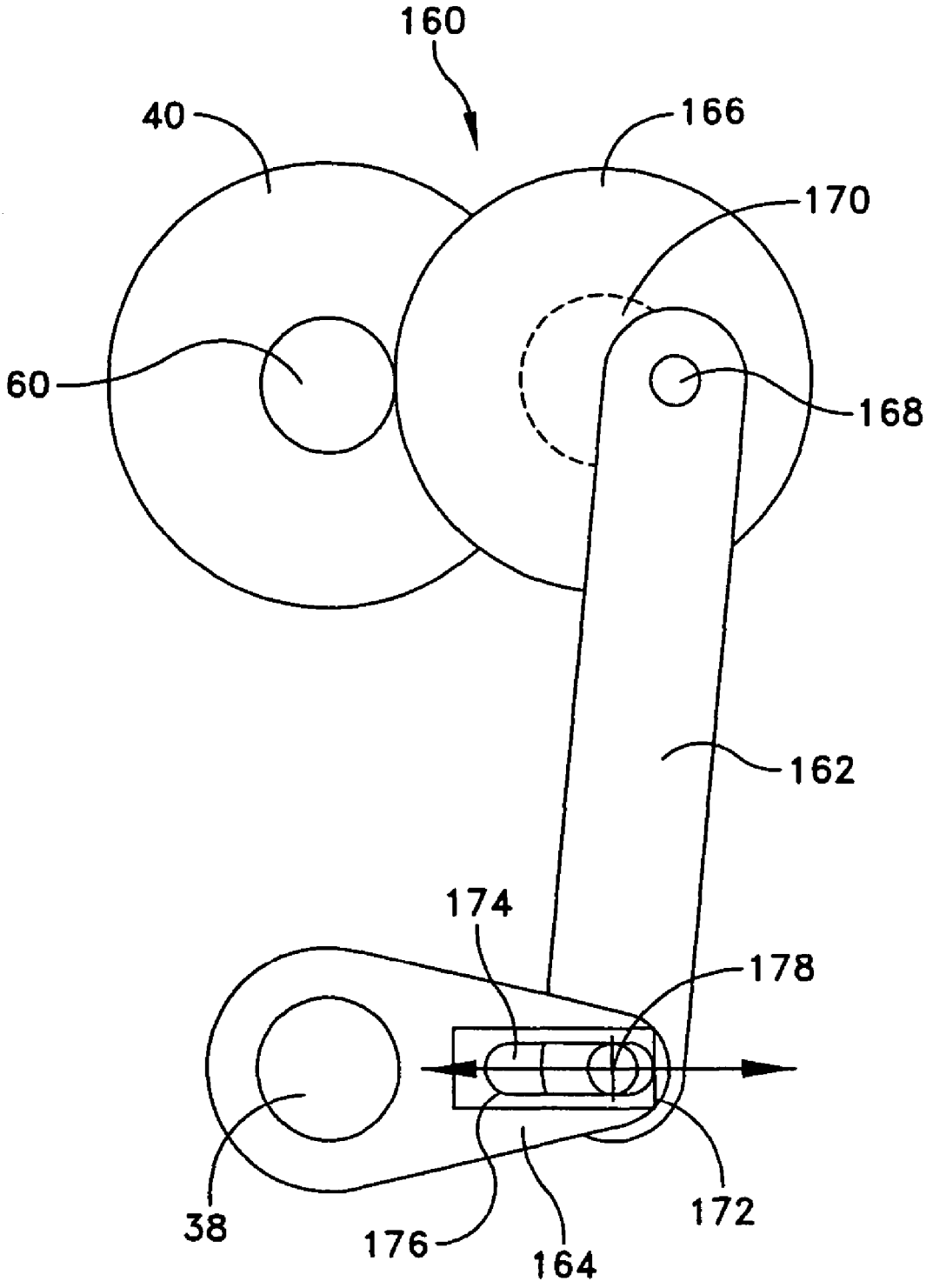
FIG. 12 is a side view of an alternative control surface actuation system.

FIG. 12 shows an alternative drive arrangement 160. The drive arrangement 160 has a linkage 162 that in addition to being pivotable relative to a crank 164 can move transversely relative to the crank 164. The motor 40 of the drive arrangement 160 rotates the pinion 60. The pinion 60 rotates a primary gear 166. The linkage 162 has a first end 168 that is pivotally connected to the primary gear 166. The first end 168 of the linkage 162 moves in a circular path shown as a phantom line 170 about the rotational axis of the primary gear 166.

Still referring to FIG. 12, the link 162 has a second end 172 that is pivotally connected to the crank 164. The crank 164 has a crank slot 174 that allows the second end 172 to move radially in and away from the shaft 38. The drive arrangement 160 has an actuator device 176 to control the position of the pivot point 178 of the link. When the pivot point 178 is closer to the shaft 38, the vertical travel of the link 162 allows for a greater variation of the fin angle than when the pivot point 178 is farther from the shaft 38.

While the slot 174 is shown on the crank 164, it is recognized that the slot could be placed on the primary gear 166.

Figure 13:
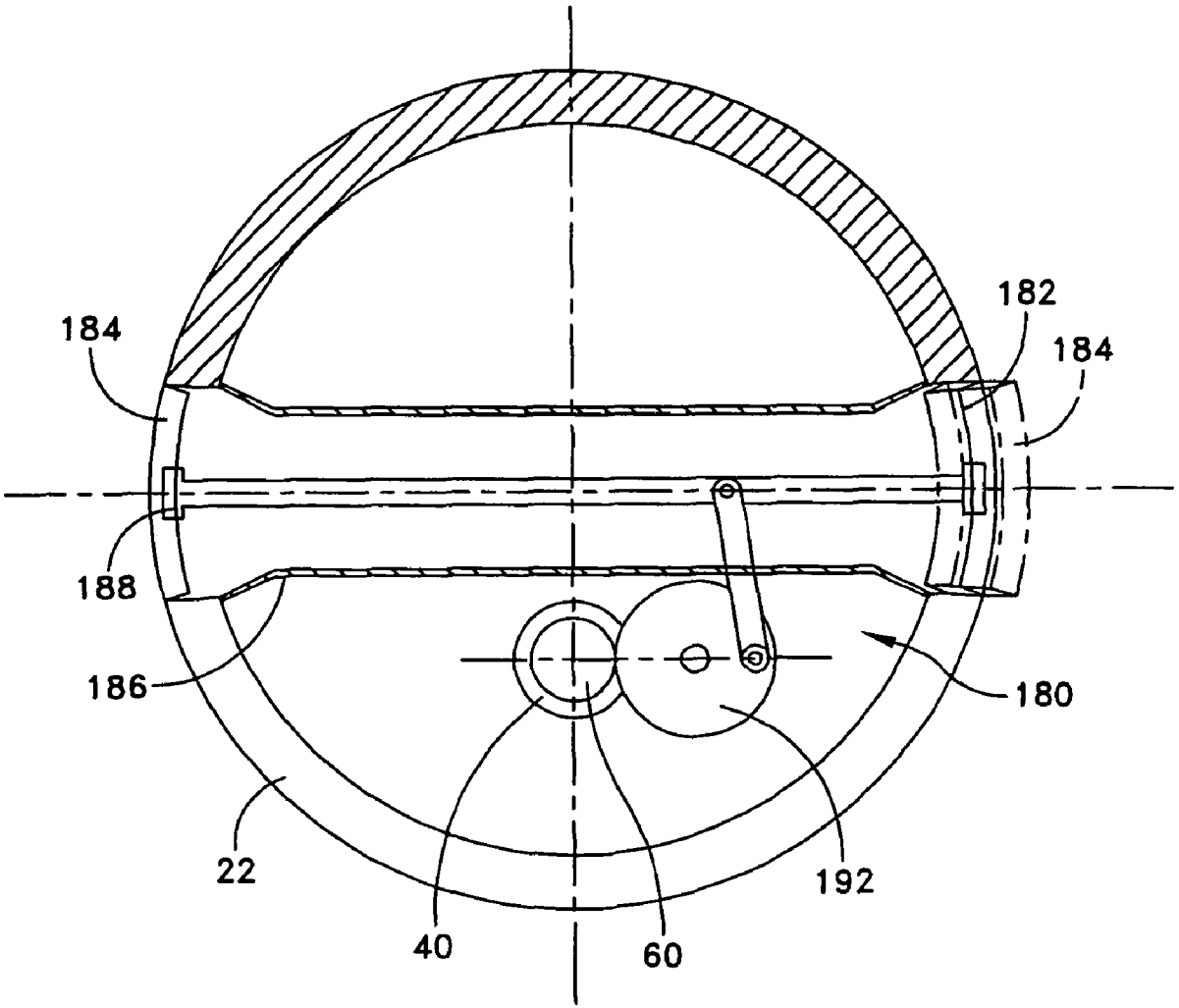
FIG. 13 is an enlarged cross section of a portion of the projectile with an alternative aerodynamic control surface.
Figure 14:
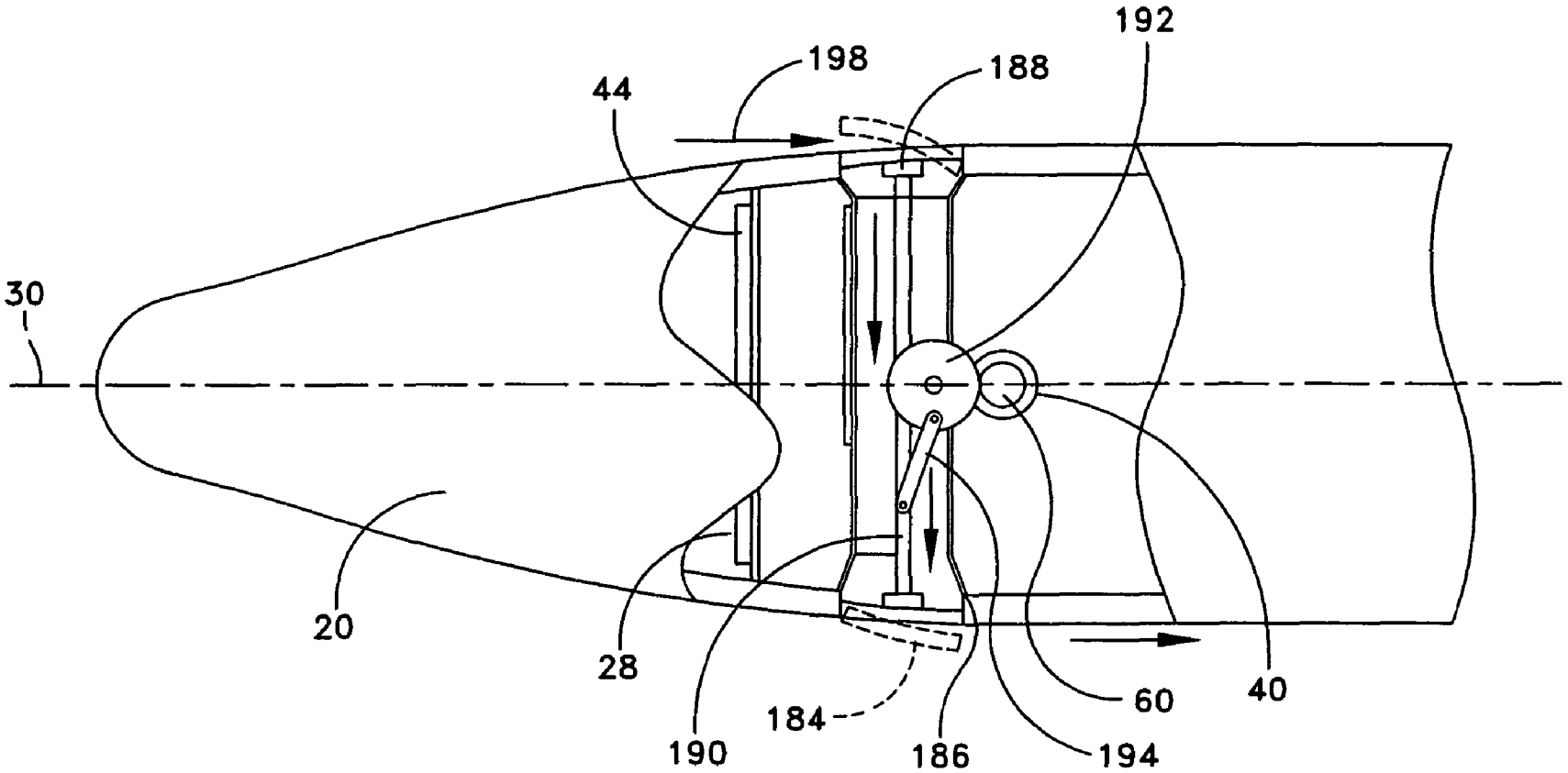
FIG. 14 is a side elevation partial cutaway view of a portion of the projectile with the alternative aerodynamic control surface.

FIGS. 13 and 14 show an alternative drive arrangement 180 with an alternative aerodynamic device 182. The projectile 20 has a pair of valves 184 and an interposed cavity 186 for the passage of air. The valves 184 are each driven through a flexible joint 188 connected to a shaft 190. The flexible joint could be various items including a pin, a hinge, or a compliant metal or polymeric component. Similar to the previous embodiments, the motor 40 drives the pinion 60 which engages a primary gear 192. The drive arrangement 180 has a link 194 interposed between the primary gear and a crank 196 carried by the shaft 190.

The valves 184 are opened and closed so that air is scooped on one side of the projectile 20 and moves through the cavity 186 and exits the other side of the projectile as represented by the valves 184 shown in phantom and the arrows 198.

Figure 15:
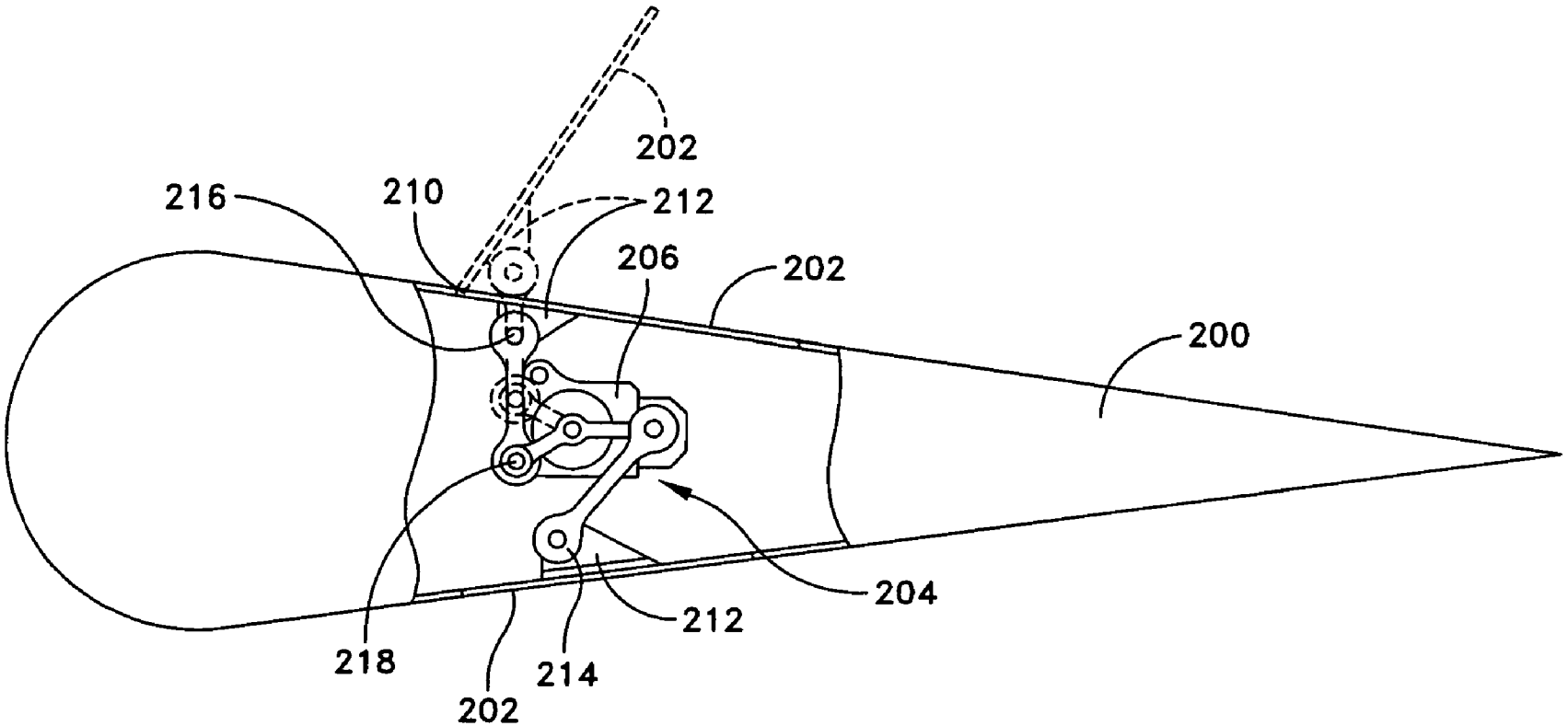
FIG. 15 is a schematic cross section view of a wing of an aircraft with a control surface actuation system.
Figure 16:
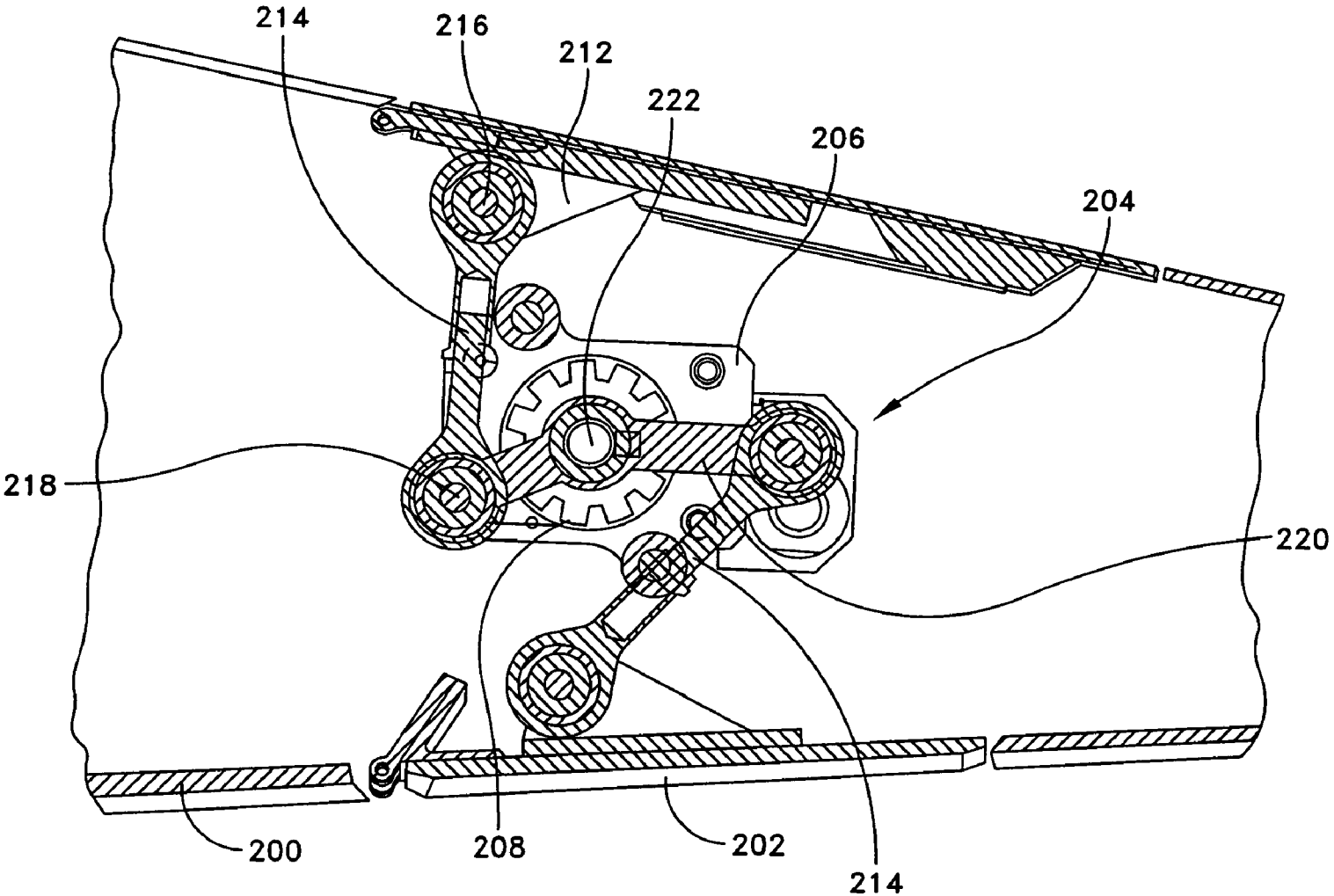
FIG. 16 is an enlarged section of a portion of the wing with a control surface actuation system.

In addition to using a control surface actuation system in the projectile 20 such as illustrated in FIGS. 1, 3-5, 8-9B, 12, and 13-14, the control surface actuation system can be used in other devices such as an aircraft or missile. Referring to FIG. 15, a sectional view of a wing 200 of an aircraft is shown with a portion exposed. FIG. 16 is an enlarged section of the wing 200. The wing 200 has a pair of aerodynamic surfaces 202. The aerodynamic surfaces 202 are controlled by a control surface actuation system, a drive arrangement, 204 that has a motor 206 and a gear head 208 with at least one gear. Each of the aerodynamic surfaces 202 is pivotally mounted at a pivot point 210. The control surface actuation system 204 has a crank 212 mounted to the aerodynamic surface 202. For each aerodynamic surface 202, there is a link 214 pivotally connected to the crank 212 at a first end 216. Each of the links 214 has a second end 218 which is pivotally connected to an arm 220. Each of the arms 220 is connected to a shaft 222 in the gear head 208.

One of the aerodynamic surfaces 202 and associated link 214 and arms 220 are shown in phantom deployed position in FIG. 15. In the embodiment shown, the aerodynamic surfaces 202 are air brakes.

Figure 17:
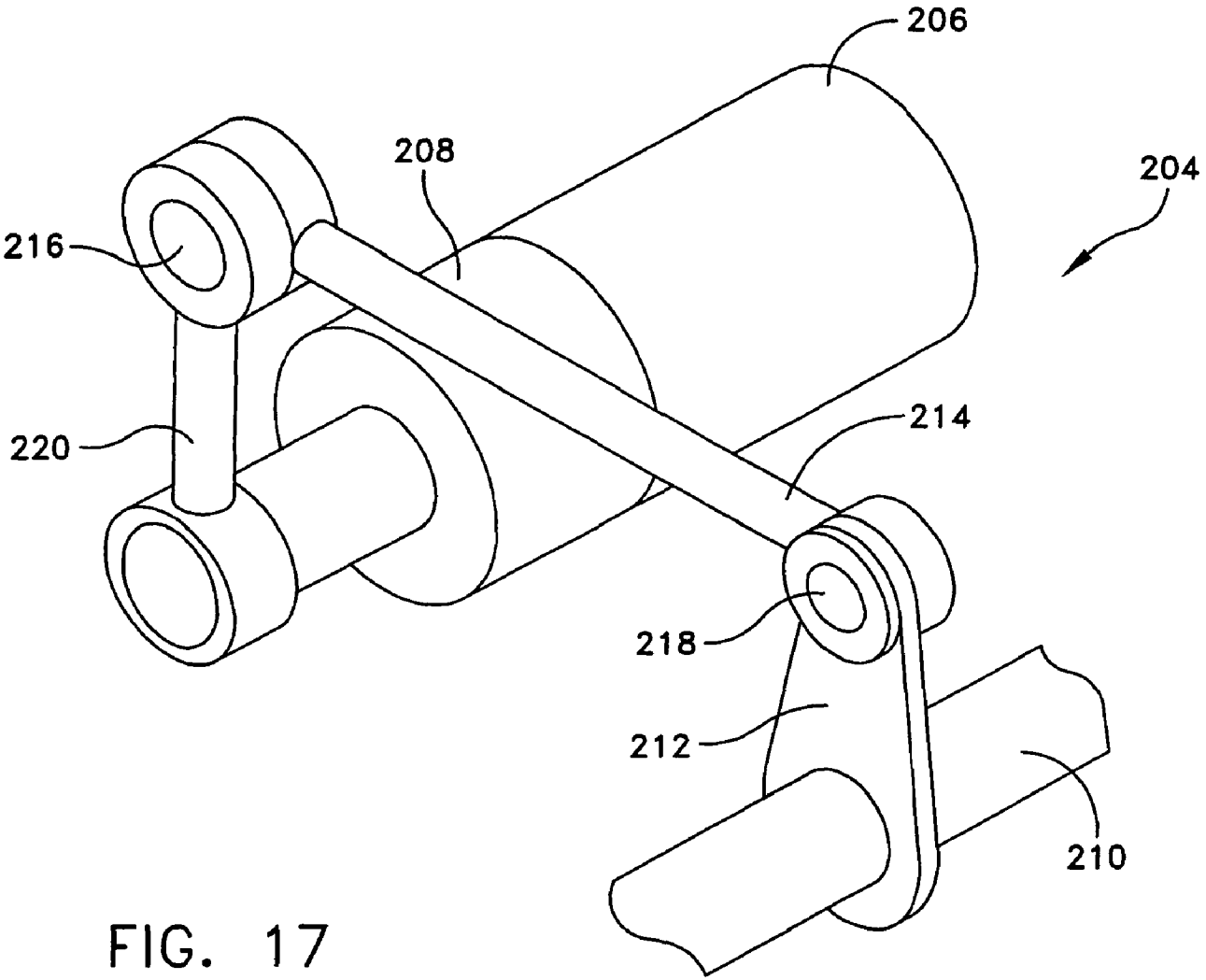
FIG. 17 is a perspective schematic view of the control surface actuation system.

Referring to FIG. 17, a perspective view of the control surface actuation system 204 is shown. In this arrangement there is only one arm 220 driving an output shaft through one link. The control surface actuation system, a drive arrangement, 204 has the motor 206 and the gear head 208 with at least one gear. The gear head 208 is located along the longitudinal axis of the motor 206. The gear head 208 is connected to the arm 220. The aerodynamic surfaces 202 shown in FIGS. 15 and 16 are each connected to the crank 212.

Interposed between the crank 212 and the arm 220 is the link 214. Each of the ends 216 and 218 of the link are connected to the respective crank 212 and the arm 220 by a rotating joint such as a pin or ball joint. The pivot point 210 for the aerodynamic surface can be a shaft, pin, bearing, or similar device.

Figure 18:
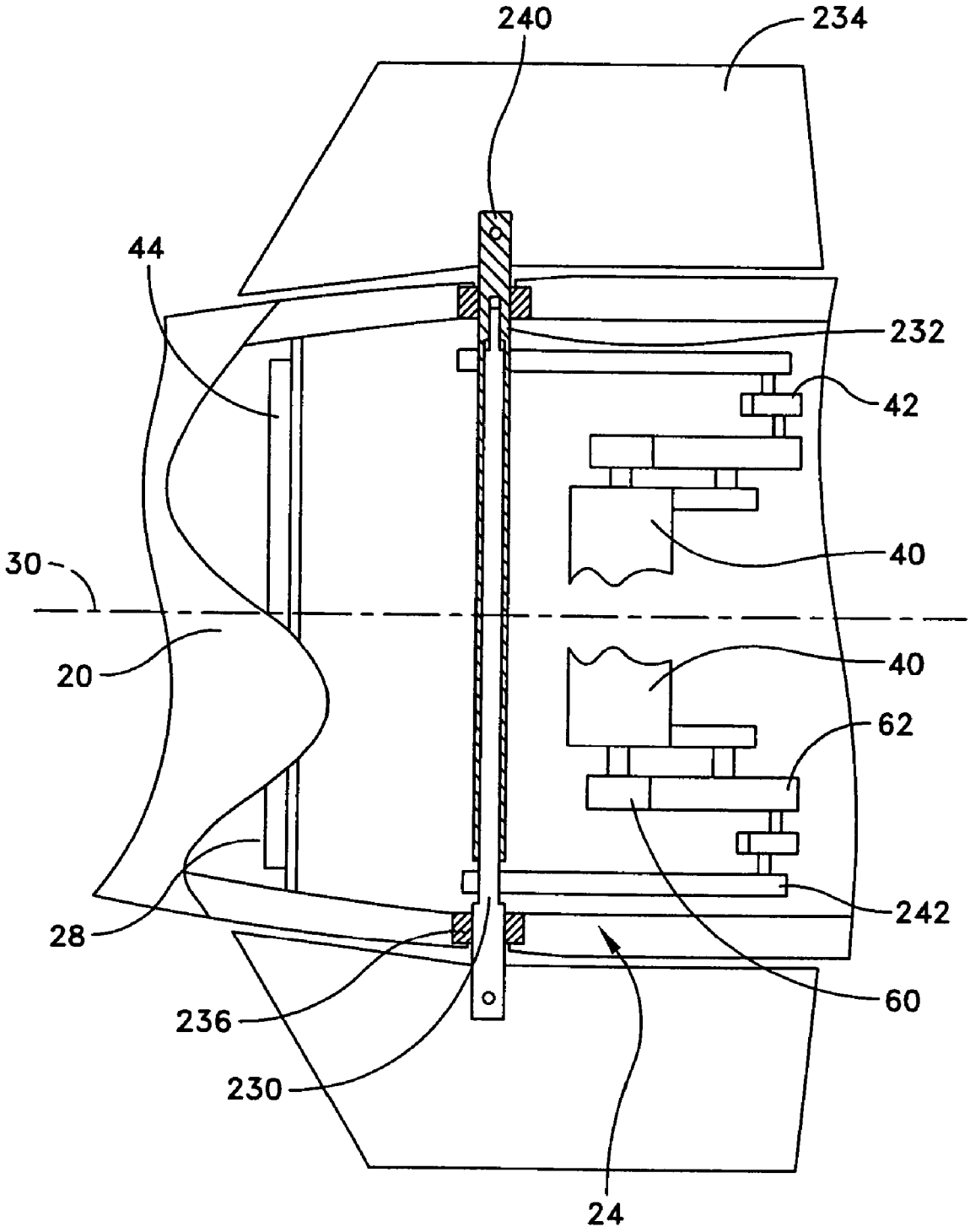
FIG. 18 is side elevation partial cutaway view of a projectile of an alternative arrangement.

Referring to FIG. 18, an alternative arrangement of the control surface actuation system 24 is shown. The system 24 has a pair of shafts 230 and 232. The shaft 230 is the inner shaft and lies in the hollow of the second shaft 232. A fin 234 is mounted on each of the shafts 232 about a common axis.

Each shaft 230 and 232 turns on a bearing 236 that is captured in a housing 238 of the projectile 20. The nub 240 of each shaft 230 and 232 that protrudes beyond the housing through the bearing 236 attaches to the fin 234 so that it will turn the fin 234. The fins 234 could be rigidly attached to the fin shaft 230 and 232 or pivotally attached to the fin shaft so the fins can be stowed. A crank 242 is attached to each of the shafts 230 and 232. Each crank 242 is attached to a respective motor 40 through a linkage 42 driven by a pin eccentrically mounted to the output gear 62. This configuration would allow for both directional and spin control of the projectile.

While this invention has been particularly shown and described with references to preferred embodiments thereof, it will be understood by those skilled in the art that various changes in form and details may be made therein without departing from the spirit and scope of the invention as defined by the appended claims.

For example, it is recognized that in certain embodiments of guiding the projectile it may be desirous to have the motor 40 rotate in alternative directions in contrast to always rotating in one direction.

While several of the arrangements described above describe a pinion and a gear, it is recognized that the link could be mounted eccentrically to the motor shaft. While a pair of control surfaces that are linked together are shown in FIGS. 1, 4, 5A, 5B, 5C, 5D, 8, and 14, it is recognized that there could be 1, 2, 3, 4 or more control surfaces driven either individually or in pairs.

While the eccentric drive control actuation system has been described with a non-powered projectile, it is recognized that the system can be used with a rocket propelled projectile. This is regardless of whether the projectile is spinning or not spinning.

What is claimed is:

1. A projectile comprising:

a body configured to spin about a projectile longitudinal axis during flight along a flight path;

an aerodynamic device coupled to a shaft carried by the body;

a crank coupled to the shaft, a general back and forth motion of the crank causing an oscillating motion of the shaft and the aerodynamic device;

a motor;

a drive arrangement interposed between the crank and the motor for translating unidirectional rotational motion of the motor into generally limited oscillating, back-and-forth motion of the crank and of the aerodynamic device relative to the body of the projectile; and a controller for controlling the velocity and phase of the unidirectional rotational motion of the motor to create the oscillating, back-and-forth motion of the crank and aerodynamic device in synchronism with the spinning of the body to control the flight path of the projectile.

2. A projectile of claim 1 wherein the controller receives inputs related to control activation;

spin velocity (ω) of the projectile;

spin coordination angle (θ) of the projectile;

a commanded phase angle (θ) of the aerodynamic device defining a commanded direction of veer of the projectile;

position of the aerodynamic device; and velocity of the aerodynamic device; and wherein the controller implements feed forward of a signal corresponding to the spin velocity (ω) of the projectile; and wherein the controller outputs a drive signal to vary the position and velocity of the motor to adjust a phase position of the aerodynamic device in the oscillating, back-and-forth motion to equal the commanded phase angle.

3. A projectile of claim 1 wherein the motor carries a pinion and the drive arrangement comprises:

a link having one end coupled to the crank; and a gear coupled to the pinion and carrying the other end of the link, unidirectional rotation of the gear inducing limited, back-and-forth angular motion of the crank in relation to the rotation of the motor.

4. A projectile of claim 1 wherein the motor carries a pinion and the drive arrangement comprises:

a link having one end coupled to the crank; and a gear train having a plurality of gears, the gear train coupled to the pinion and having a gear train output carrying the other end of the link, unidirectional rotation of the gears of the gear train inducing limited, back-and-forth angular motion of the crank in relation to the rotation of the motor.

5. A projectile of claim 4 wherein the motor, the gear train, and the pinion are matched to move the link at a rate of over 10 strokes per minute.

6. A projectile of claim 5 wherein the motor, the gear train, and the pinion are matched to move the link at a rate of between 100 strokes to 16,000 strokes per minute.

7. A projectile of claim 1 wherein the motor carries a pinion and the drive arrangement comprises:

a link having one end coupled to the crank;

a gear coupled to the pinion;

a pair of stop pins carried by the gear;

an arm having a pair of ends, one end pivotally carried by the gear, the other end pivotally coupled to the other end of the link, wherein the rotation of the gear in one direction moves the link into engagement with one of the stop pins and establishes a first specific amplitude of the oscillating, back-and-forth motion of the aerodynamic device, and the rotation of the gear in the other direction moves the arm into engagement with the other stop pin and establishes another specific amplitude of the oscillating, back-and-forth motion of the aerodynamic device.

8. A projectile of claim 1 further wherein the motor carries a pinion and the drive arrangement comprises:

a link having one end coupled to the crank;

a gear coupled to the pinion;

the crank coupled to the shaft having a slot for receiving the one end of the link;

an adjustment device for positioning the other end of the link in a specific position within the slot to adjust the amplitude of the motion of the crank in relation to the rotation of the motor relative to the body of the projectile.

9. A projectile of claim 1 wherein the aerodynamic device comprises a pair of fins for interacting with the air through which the projectile rotates.

10. A projectile of claim 1 wherein the aerodynamic device comprises a pair of valves and a cavity interposed between the valves for directing a flow of air through the projectile from one valve to the other valve therein redistributing the pressures acting on the projectile, the valve surfaces protruding into the air stream creating lift and drag, and also changing a boundary layer of the projectile and thus altering the flight path of the projectile.

11. A projectile of claim 1, wherein the projectile is from the group of an artillery shell, bomb, and missile and the projectile has significant spin rate about the projectile's longitudinal axis.

12. A projectile of claim 1, wherein the shaft is a first one of a pair of nested shafts, the first nested shaft being an inner shaft and a second nested shaft being an outer shaft having a hollow cavity, the inner shaft laying in the hollow cavity of the outer shaft, and wherein the aerodynamic device is a first of a pair of aerodynamic devices each mounted to a respective one of the shafts about a common axis and each being actuated independently.

13. A control surface actuation system comprising:

a control surface, the control surface having a pivot and rotatably carried by a body;

a crank coupled to the control surface, an angular motion of the crank causing a rotational motion of the control surface about the pivot;

a motor; and a drive arrangement interposed between the crank and the motor for translating rotational motion of the motor into generally angular motion of the crank, the drive arrangement including an arm having a first end coupled to the motor and an elongated link coupled between a second end of the arm and the crank, wherein the rotational motion of the motor is translated into a rotational motion of the control surface about the pivot via longitudinal motion of the link.

14. A control surface actuation system of claim 13 wherein an electronic controller operates the system as a servo actuator.

15. A control surface actuation system of claim 13 wherein the drive arrangement further includes at least one gear interposed between the motor and the link for translating high speed low torque motion into lower speed higher torque motion.

16. A control surface actuation system of claim 13 wherein the motor has a longitudinal axis that is parallel with a pivot axis of the control surface.

17. A control surface actuation system of claim 13 wherein the drive arrangement further includes:

a gear box having at least one gear coupled to the motor;

and wherein the arm extends from the gear box to the link.

18. A control surface actuation system of claim 17 wherein the link is coupled to at least one of the arm and the crank by a respective joint having three degrees of freedom.

19. A control surface actuation system of claim 18 wherein the joint is a ball joint.

20. A control surface actuation system of claim 13 wherein the control surface is a single aerodynamic surface.

21. A control surface actuation system of claim 13 wherein the control surface is one of a plurality of aerodynamic surfaces wherein each of the aerodynamic surfaces has an associated drive arrangement.

22. A control surface actuation system of claim 13 wherein the aerodynamic surface is an air brake or a spoiler panel.

23. A method of controlling a projectile comprising the steps of:

providing the projectile with a pair of aerodynamic surfaces;

rotating the projectile about a projectile longitudinal axis during flight along a flight path;

moving the pair of aerodynamic surfaces in an oscillating, back-and-forth motion in synchronism with the rotation of the projectile during the flight of the projectile to control the flight path of the projectile.

24. A method of controlling a projectile of claim 23 comprising the steps of:

firing the projectile from a gun;

creating a rotation of the projectile along a longitudinal axis of the projectile due to the rifling of the barrel of the gun;

driving a shaft of a motor in a unidirectional rotary motion at a controlled rate wherein the moving of the aerodynamic devices in the oscillating, back-and-forth motion is effected through a drive arrangement coupled between the aerodynamic surfaces and the rotating shaft of the motor.

* * * * *